US007005957B2

(12) United States Patent
Yu

(10) Patent No.: US 7,005,957 B2
(45) Date of Patent: Feb. 28, 2006

(54) MECHANISM FOR TRIP-FREE OF THE BIMETALLIC PLATE OF A SAFETY SWITCH DEVICE

(76) Inventor: Tsung-Mou Yu, No. 4, Alley 2, Lane 23, Sec. 3, Pa Te Road, Panchiao City, Taipei Hsien (TW)

( * ) Notice: Subject to any disclaimer, the term of this patent is extended or adjusted under 35 U.S.C. 154(b) by 0 days.

(21) Appl. No.: 10/856,964

(22) Filed: May 29, 2004

(65) Prior Publication Data

US 2005/0264392 A1 Dec. 1, 2005

(51) Int. Cl.
*H01H 71/16* (2006.01)
*H01H 71/58* (2006.01)

(52) U.S. Cl. ..... 337/66; 337/68; 337/72

(58) Field of Classification Search ..... 337/66–69, 337/59, 70, 72, 74, 75, 126; 29/622; 200/339, 200/401, 553
See application file for complete search history.

(56) References Cited

U.S. PATENT DOCUMENTS 4,167,720 A 9/1979 Krasser ..... 337/60
4,937,548 A 6/1990 Sdunek ..... 337/70
5,223,813 A 6/1993 Cambreleng et al. ..... 337/66
5,262,748 A 11/1993 Tsung Mou ..... 337/66
5,451,729 A 9/1995 Onderka et al. ..... 200/18
5,558,211 A 9/1996 Heydner et al. ..... 200/553
6,400,250 B1 * 6/2002 Wang ..... 337/66

* cited by examiner

*Primary Examiner*—Anatoly Vortman
*Assistant Examiner*—Corey Broussard

(57) ABSTRACT

A switch device includes a case with a switch member pivotally engaged with the open top of the case. Two terminals extend from a bottom of the case and a bimetallic plate has a first end fixed to one of the terminals. A distal end of the bimetallic plate is located above the other terminal. A hooking member has one end connected to the switch member and the other end has a hooking portion with which the distal end of the bimetallic plate is engaged. The distal end of the bimetallic plate is lifted when the switch member is pushed to "ON" position. The hook portion is defined between first and second boards and the second board located lower than the first board is shorter so that the bimetallic plate is allowed to be deformed without obstruction when the switch device is overloaded.

6 Claims, 19 Drawing Sheets

(ON)

(OFF)

(ON)

(OFF)

MECHANISM FOR TRIP-FREE OF THE BIMETALLIC PLATE OF A SAFETY SWITCH DEVICE

FIELD OF THE INVENTION

The present invention relates to a switch device that includes a hooking member connected to a switch member and the hooking member includes a short sidewall so as to allow the bimetallic plate of the switch device in "ON" status to be deformed without obstruction when the switch device is overloaded.

BACKGROUND OF THE INVENTION

A conventional circuit breaker incorporates a fuse between a switch and the circuit so that when there is an electrical overloading, the fuse will first melt before the overloading causes damages. However, if the fuse is not properly installed or an improper fuse is used, the overloaded current cannot melt the fuse and a disaster can occur. U.S. Pat. Nos. 5,262,748, 4,167,720, 4,937,548, 5,223,813, 5,451,729, and 5,558,211 all disclose different types of circuit breakers which commonly include a complicated mechanism to drive the bimetallic plate which is expected to be deformed and bent when the circuit breaker is overloaded. Nevertheless, it is noted that the bimetallic plate may not be completely deformed as desired in some cases. If it is not possible to be freely deformed, and is still in contact with the terminal, sparks could be produced and therefore cause disaster.

Therefore, it is desired to have a safety switch device that allows the bimetallic plate to be freely deformed when the switch device is overloaded so as to resolve the shortcomings of the conventional switch devices.

SUMMARY OF THE INVENTION

In accordance with an aspect of the present invention, there is provided a safety switch device that comprises a case and a switch member pivotally engaged with an open top of the case. A first terminal and a second terminal respectively extend through a bottom of the case. A bimetallic plate has a first end fixed to the first terminal and a first contact point is connected to a free end of the bimetallic plate. A second contact point is connected to the second terminal and located beneath the first contact point. A hooking member has a first end pivotally connected to an end of the switch member and a second end of the hooking member has a hook portion with which a second end of the bimetallic plate is removably engaged. A biasing member is connected to an inside of the case and a side opposite to the hook portion of the hooking member contacts the biasing member.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
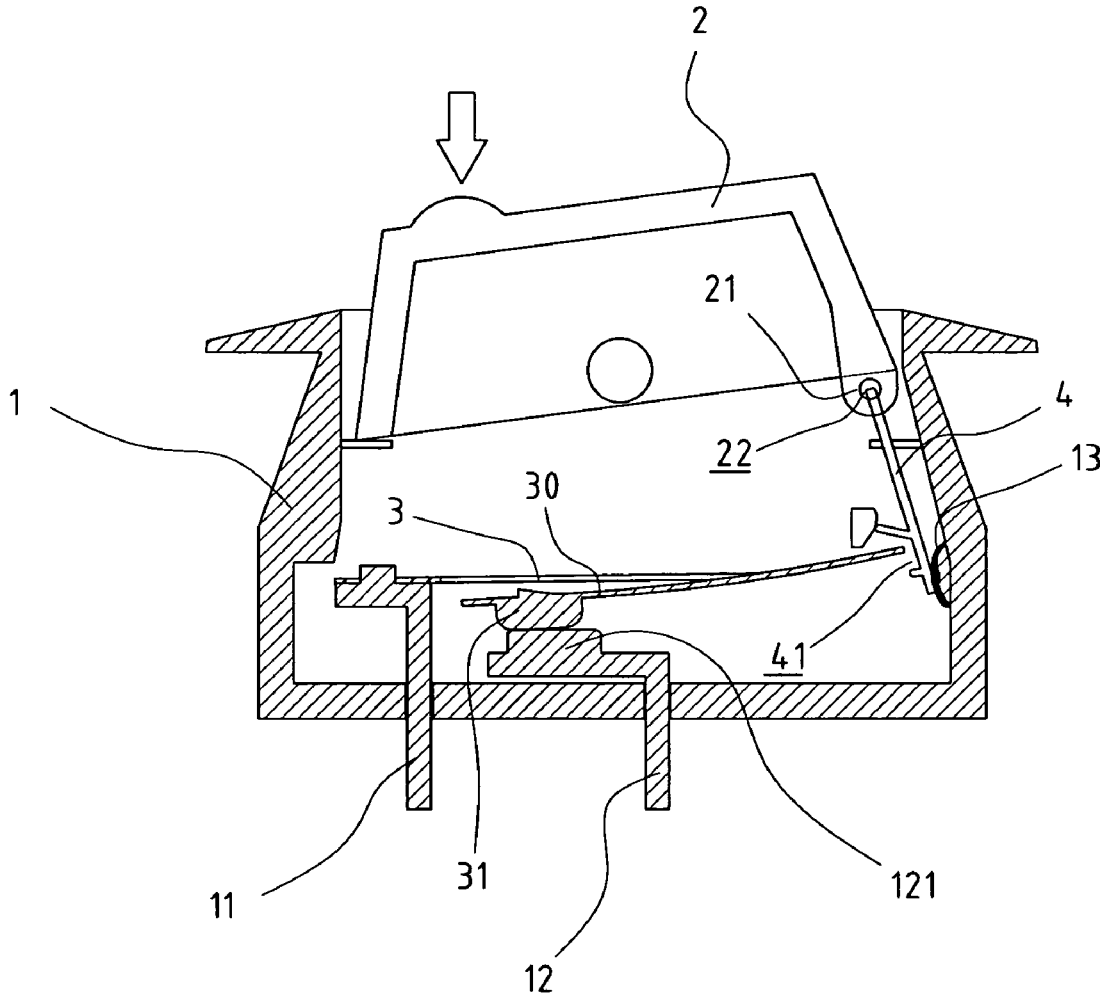
FIG. 1 shows an "ON" status of a switch device of the present invention.
Figure 2:
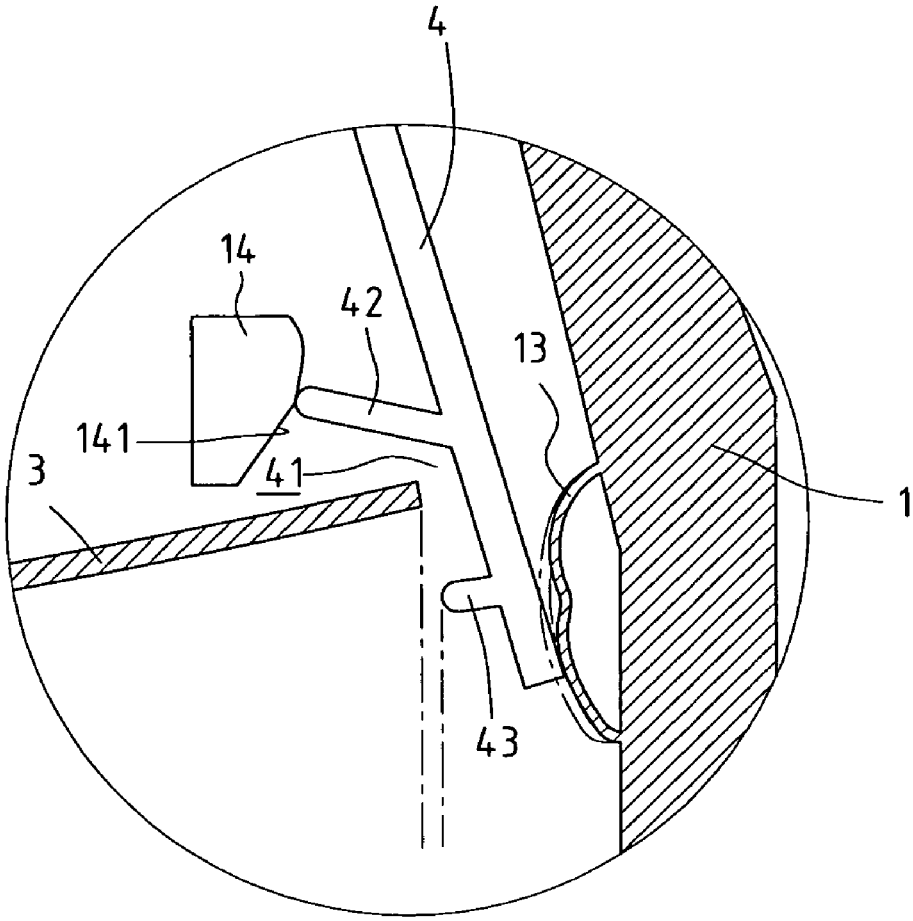
FIG. 2 is an enlarged view showing positional relationship between a hooking portion and a second end of a bimetallic plate at the "ON" status of the switch device of the present invention.
Figure 7:
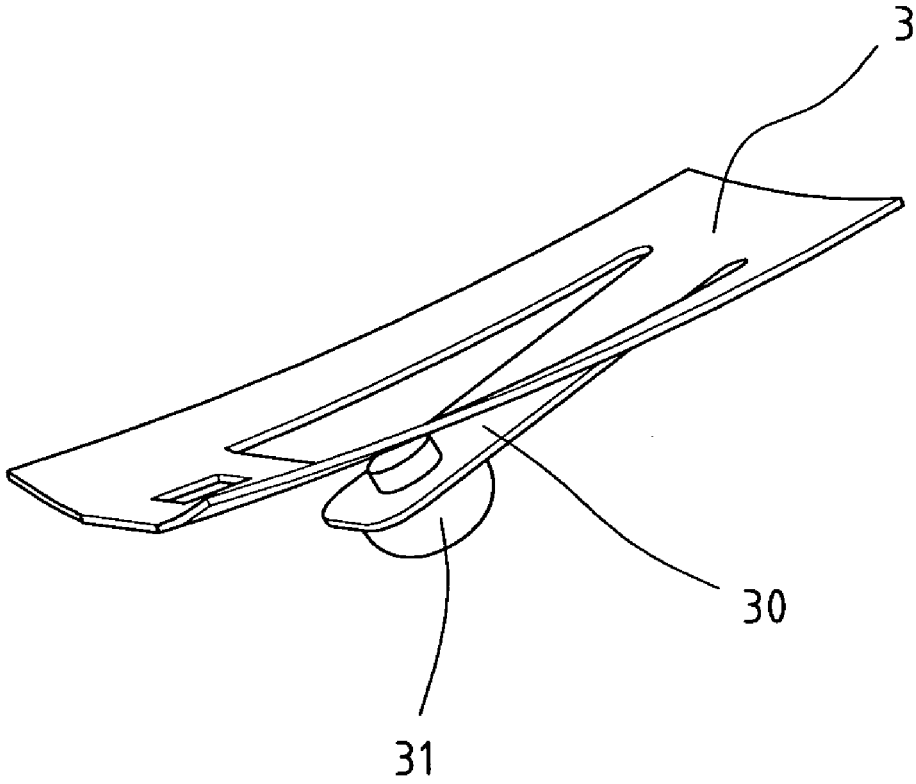
FIG. 7 shows the bimetallic plate in "ON" status.
Figure 8:
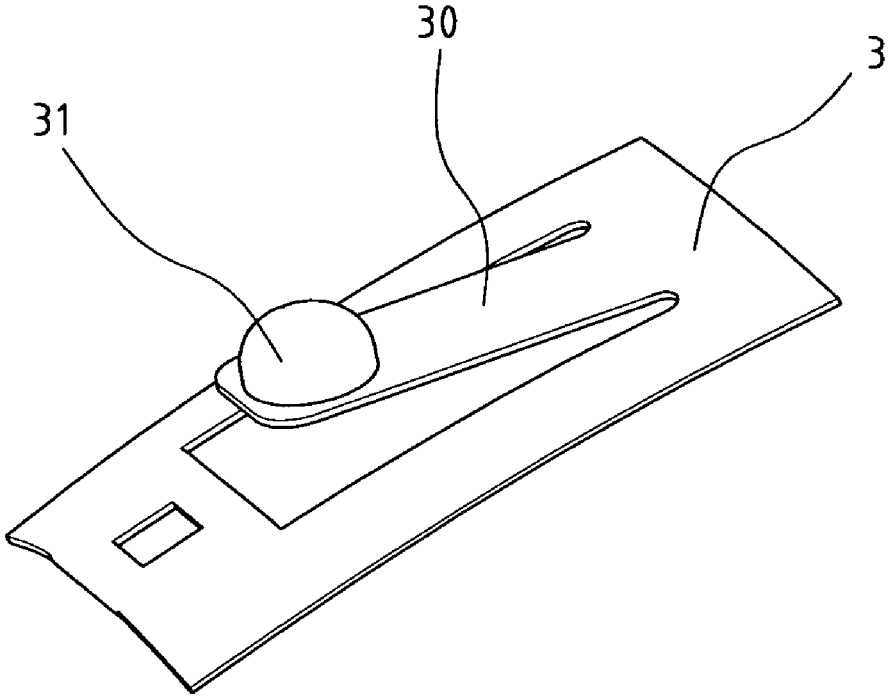
FIG. 8 shows the bimetallic plate deformed when in "ON" status.

Referring to the drawings and in particular FIGS. 1 and 2, a switch device of the present invention comprises a case 1 having an open top and a switch member 2 is pivotally engaged with the open top of the case 1. A first terminal 11 and a second terminal 12 respectively extend through a bottom of the case 1. A bimetallic plate 3 as shown in FIGS. 7 and 8 has a first end fixed to the first terminal 11 and a first contact point 31 is connected to a free end 30 of the bimetallic plate 3. The free end 30 is split from the bimetallic plate 3 and the first contact point 31 is connected to the free end 30. A second contact point 121 is connected to the second terminal 12 and located beneath the first contact point 31.

Figure 9:
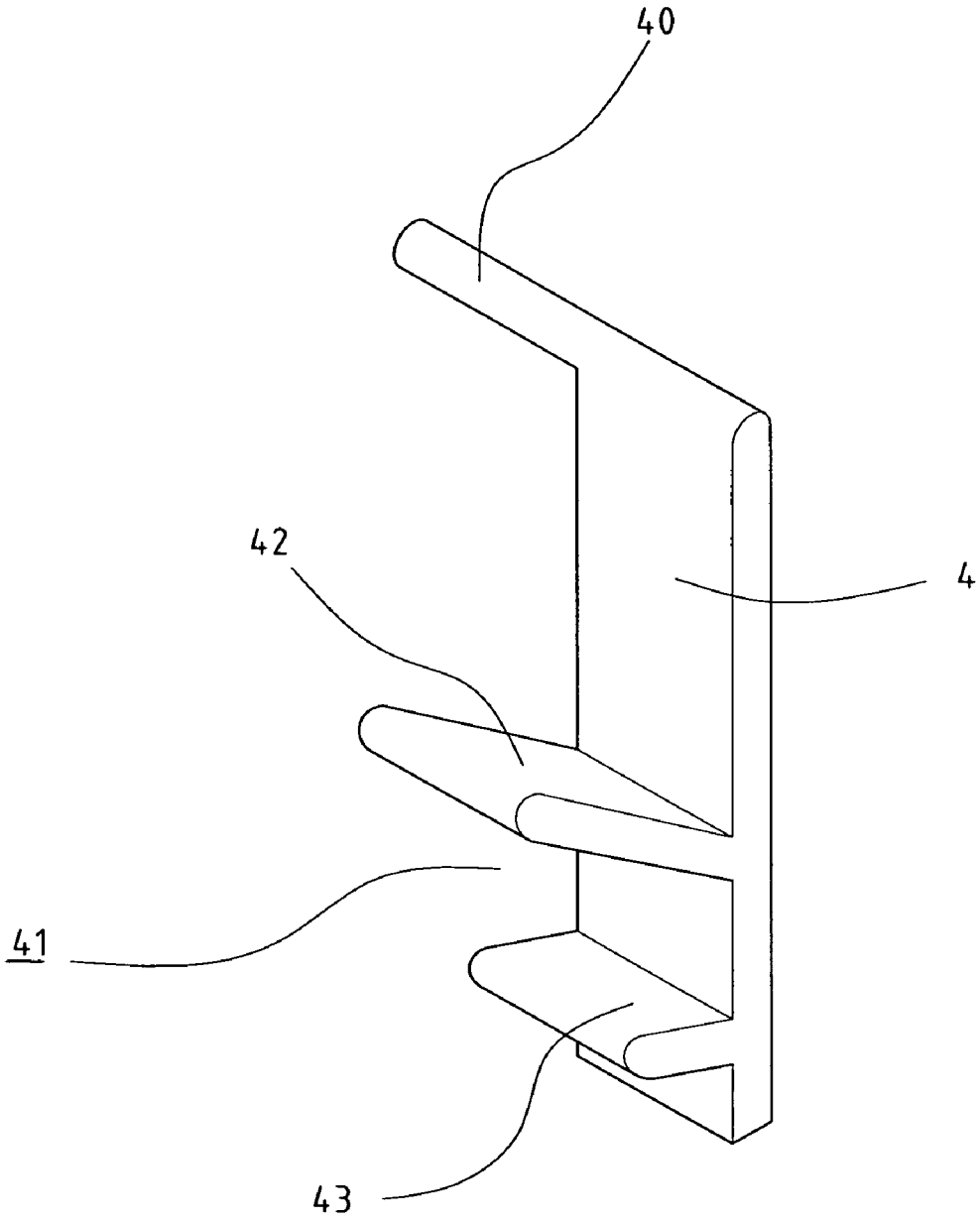
FIG. 9 shows the hooking portion of the hooking member.
Figure 10:
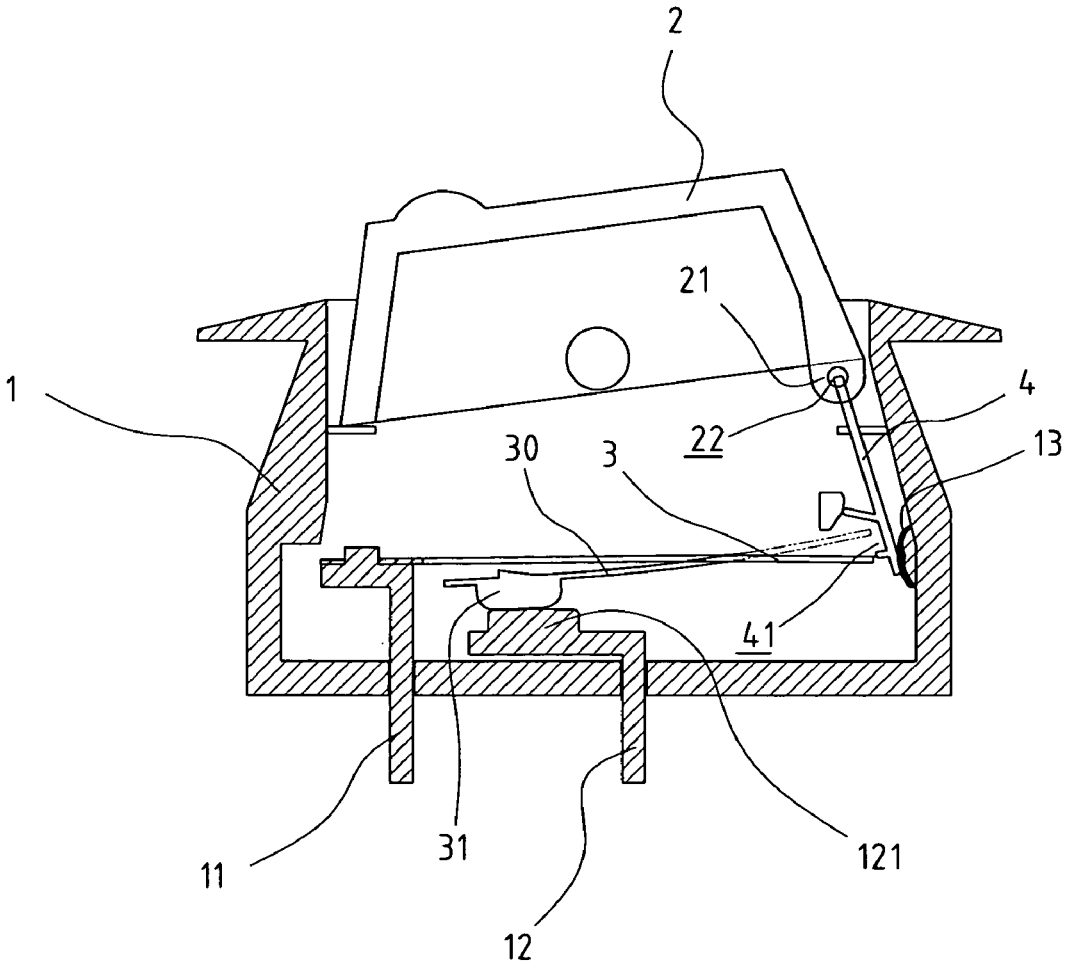
FIG. 10 shows that the bimetallic plate is deformed when the switch device is overloaded.
Figure 11:
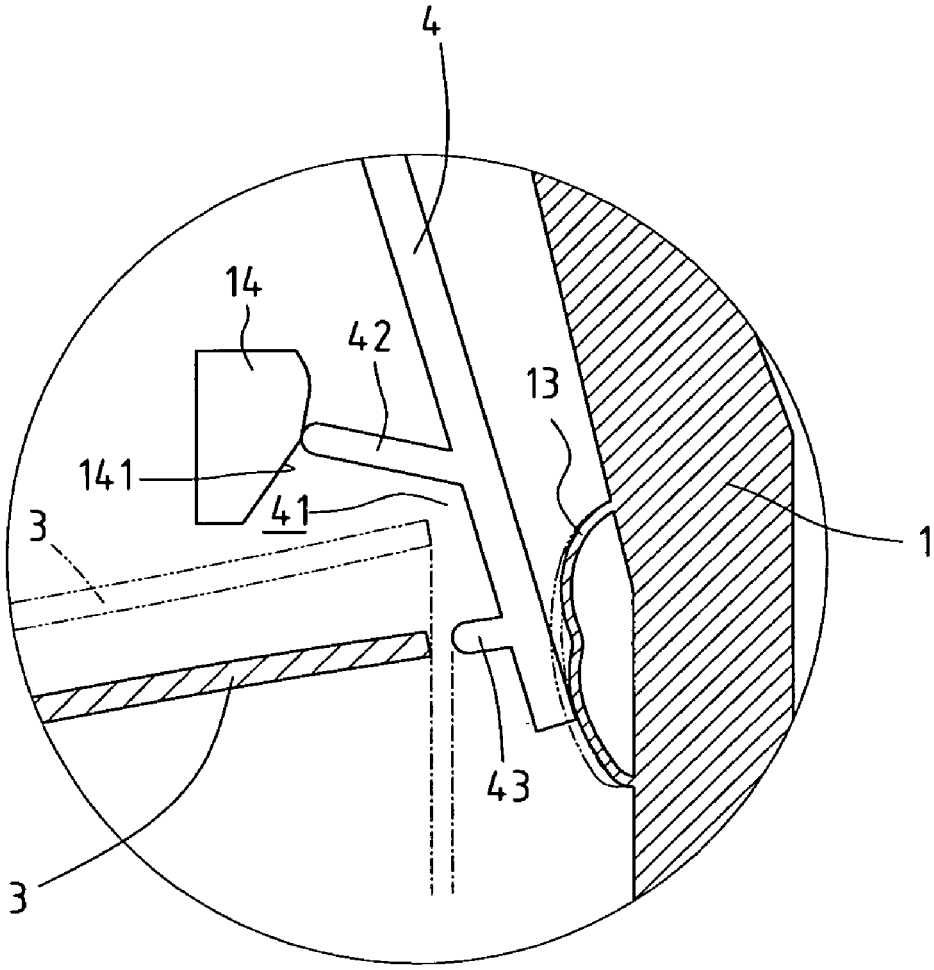
FIG. 11 shows the second end of the bimetallic plate deformed without obstruction from the hooking portion of the hooking member.
Figure 12:
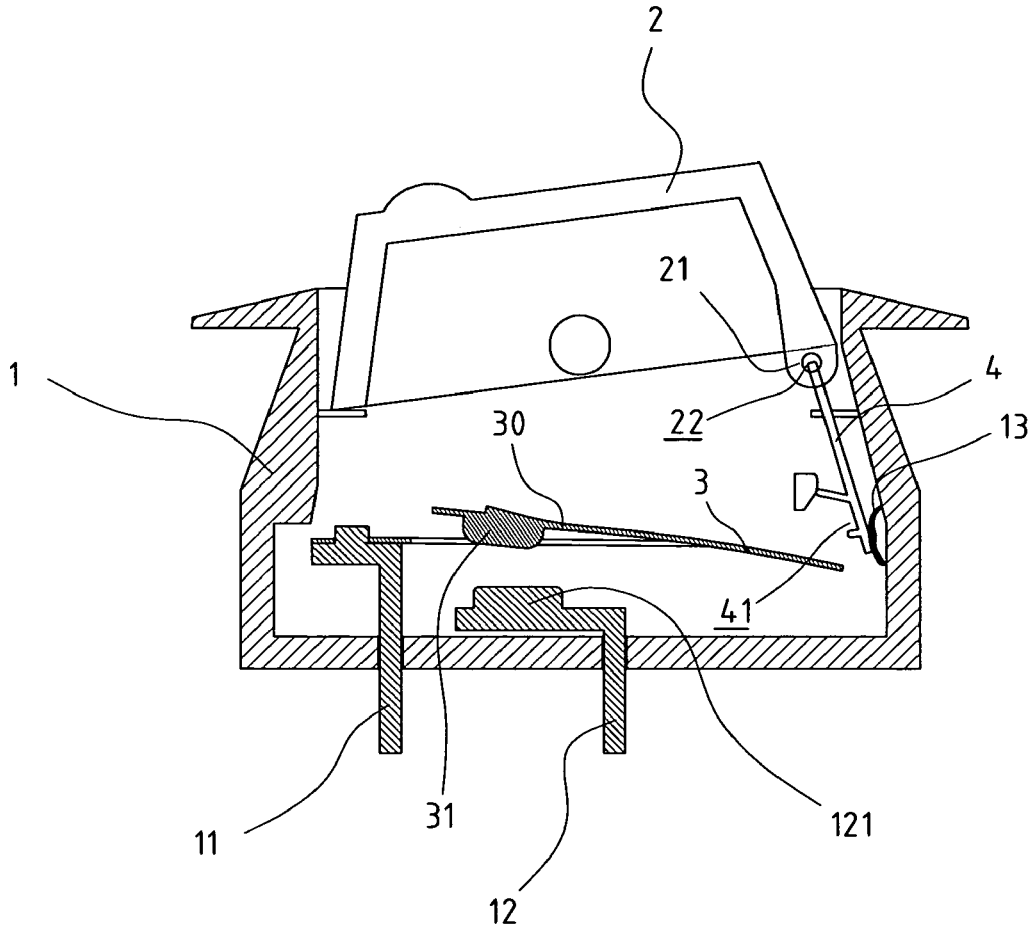
FIG. 12 shows that the first and second contact points are separated due to the deformation of the bimetallic plate when the switch device is overloaded.
Figure 13:
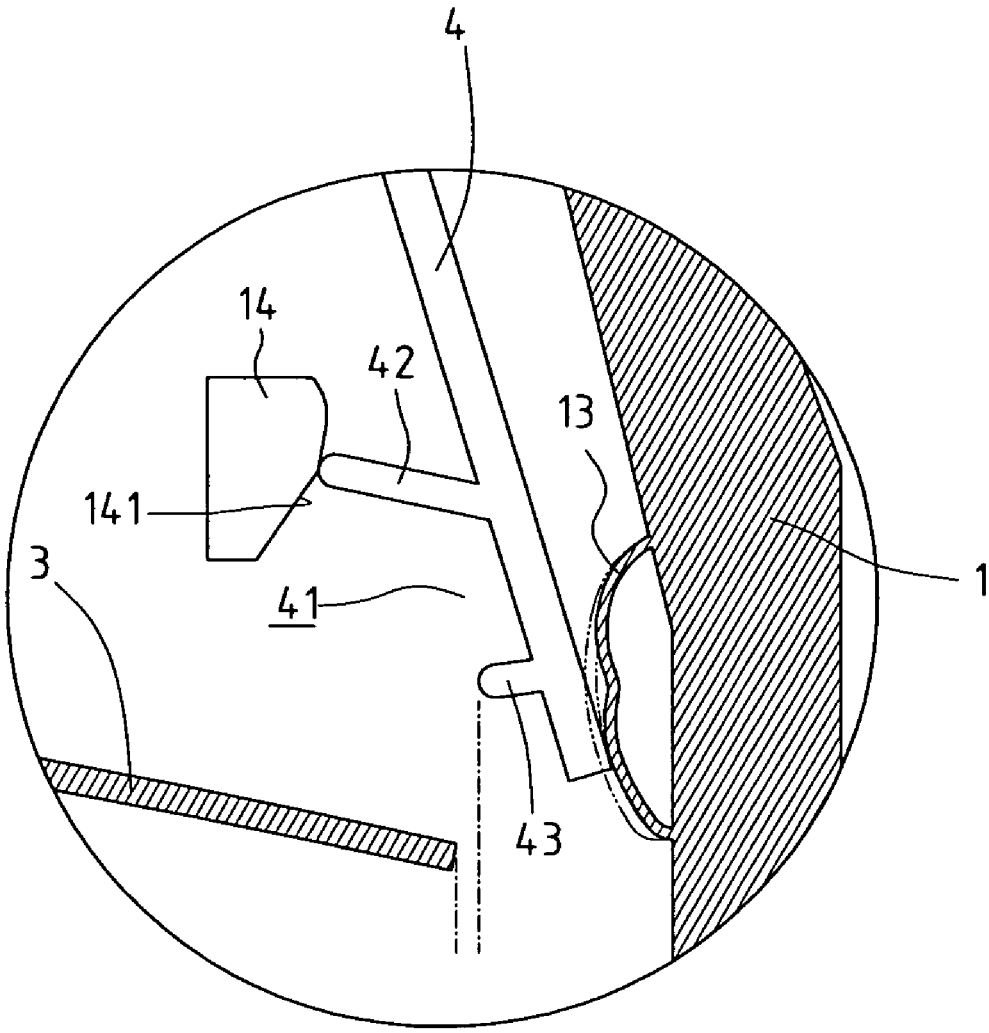
FIG. 13 is an enlarged view to show the second end of the bimetallic plate is disengaged from the hooking portion of the hooking member as shown in FIG. 12.
Figure 14:
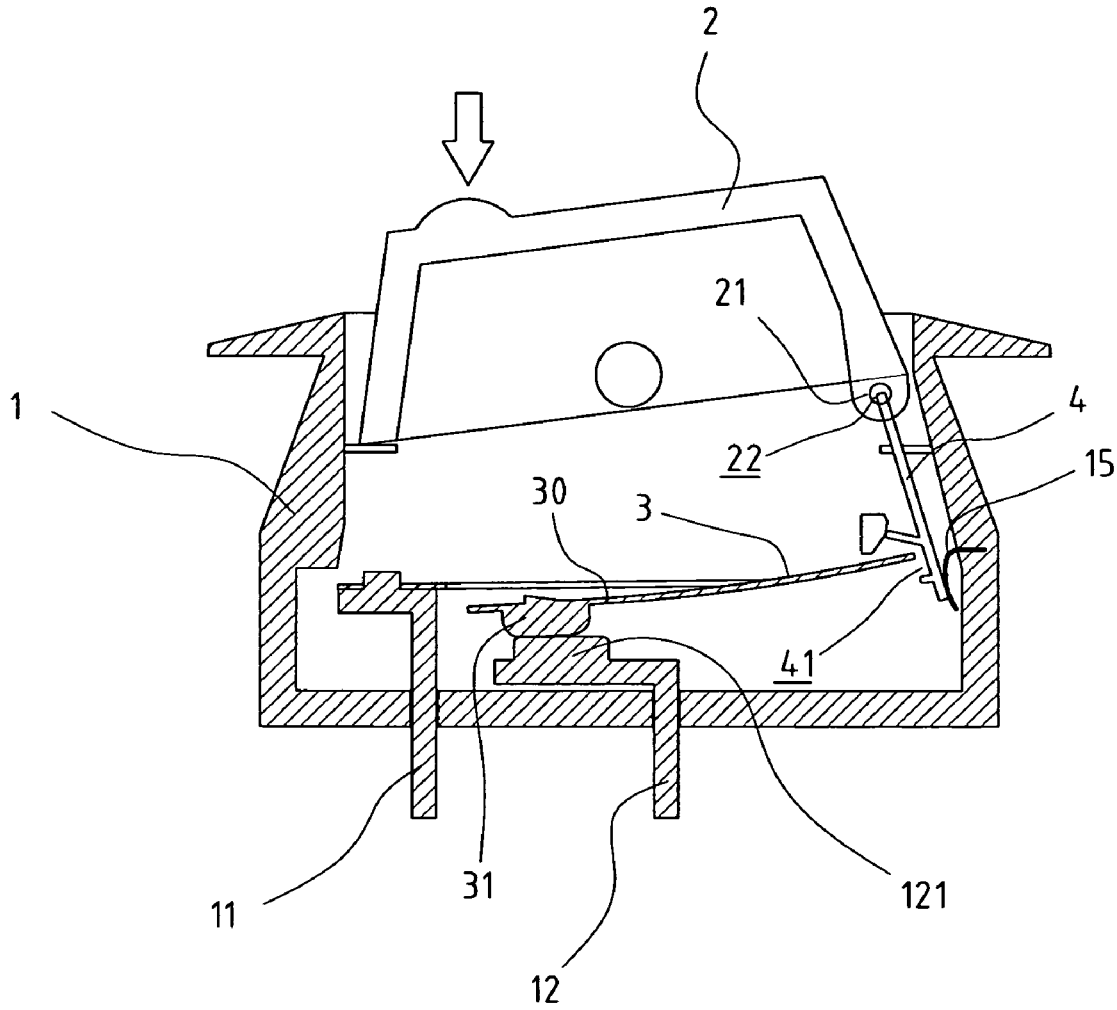
FIG. 14 shows the other embodiment of the biasing member used in the switch device of the present invention in "ON" status.
Figure 15:
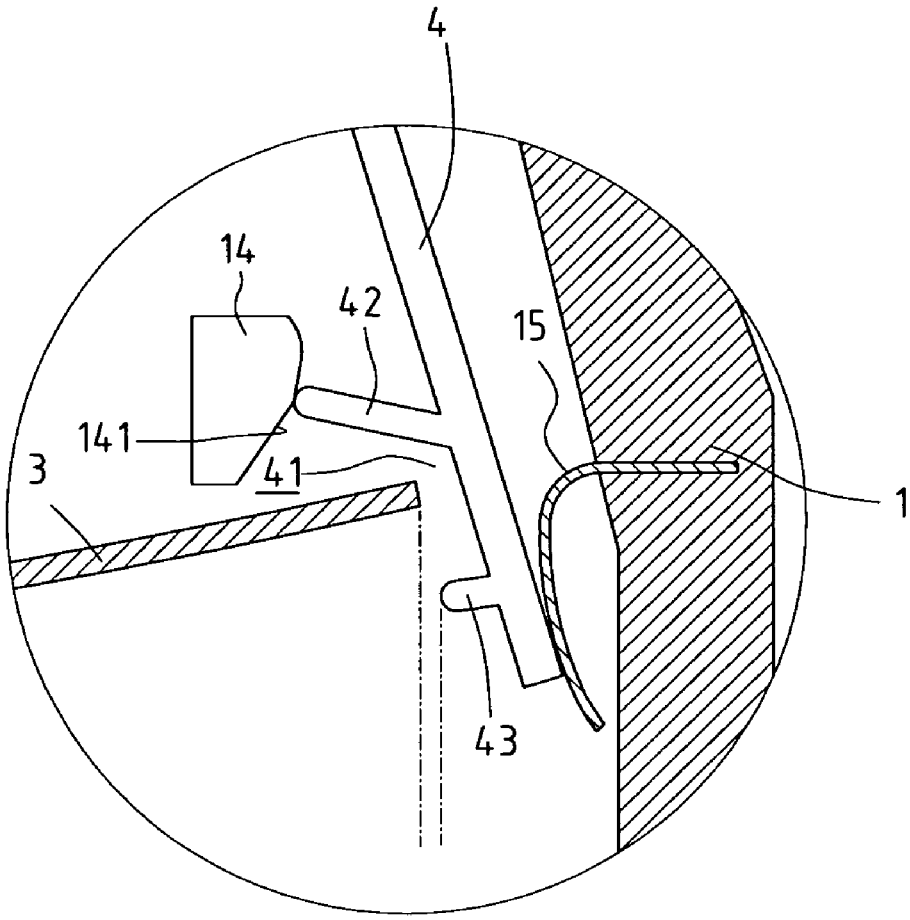
FIG. 15 is an enlarged view to show position relationship between the hooking portion and the second end of the bimetallic plate at the "ON" status of the switch device of the present invention using the biasing member disclosed in FIG. 14.
Figure 16:
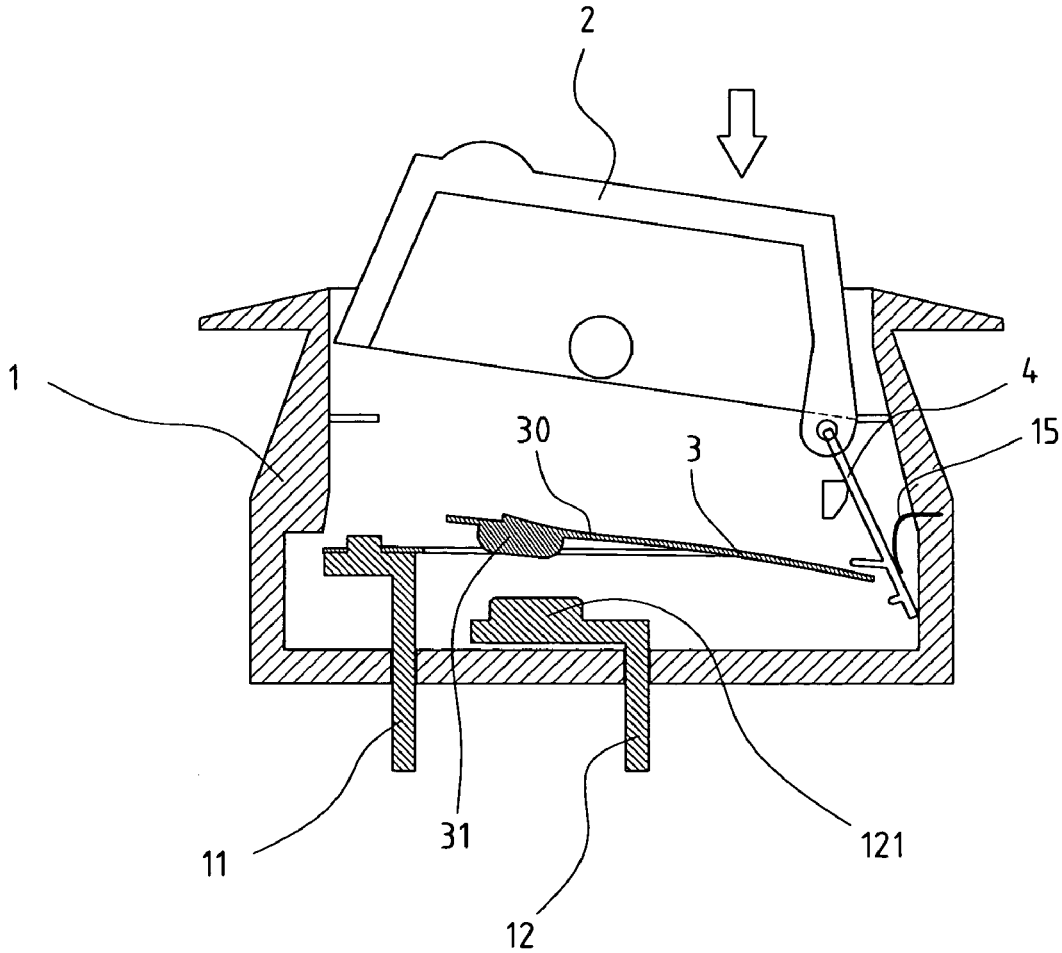
FIG. 16 shows the biasing member in FIG. 14 used in the switch device of the present invention in "OFF" status.
Figure 17:
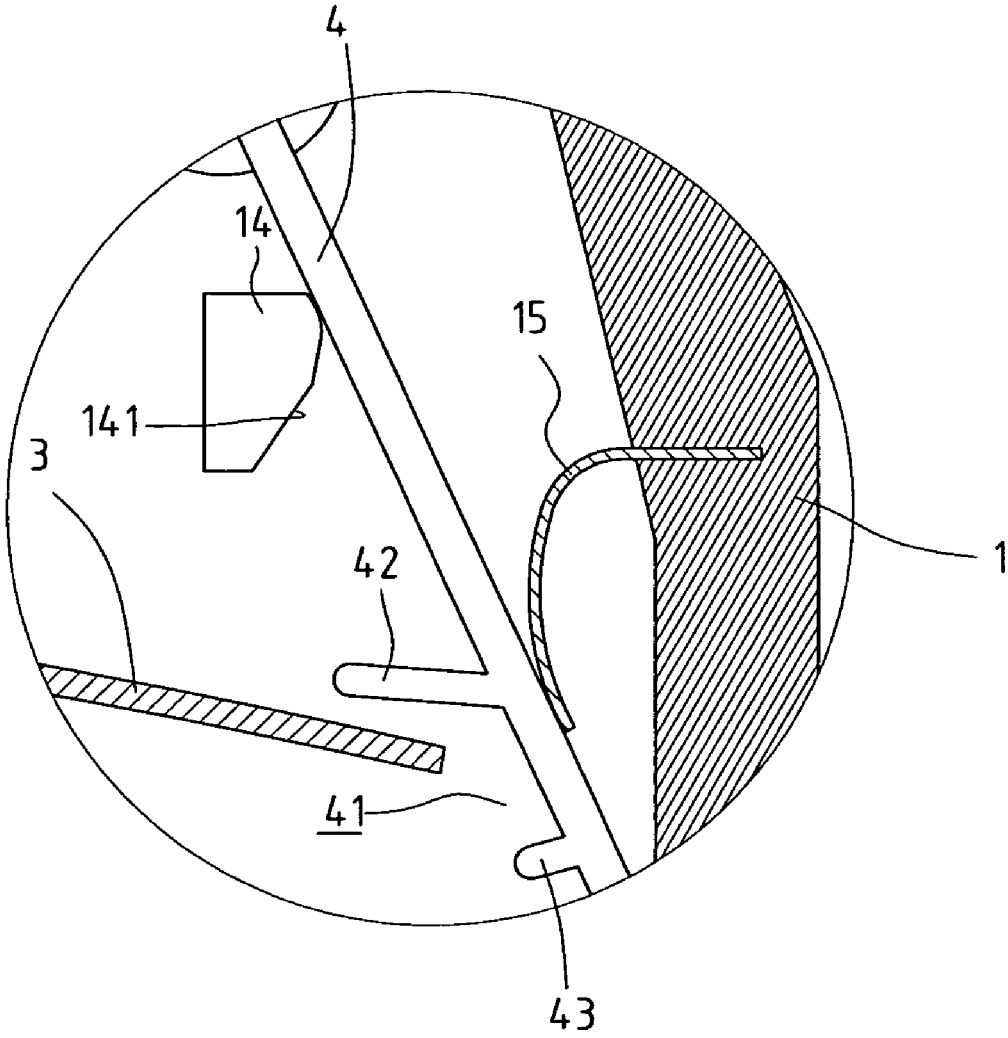
FIG. 17 is an enlarged view to show position relationship between the hooking portion and the second end of the bimetallic plate at the "OFF" status of the switch device of the present invention using the biasing member disclosed in FIG. 14.
Figure 18:
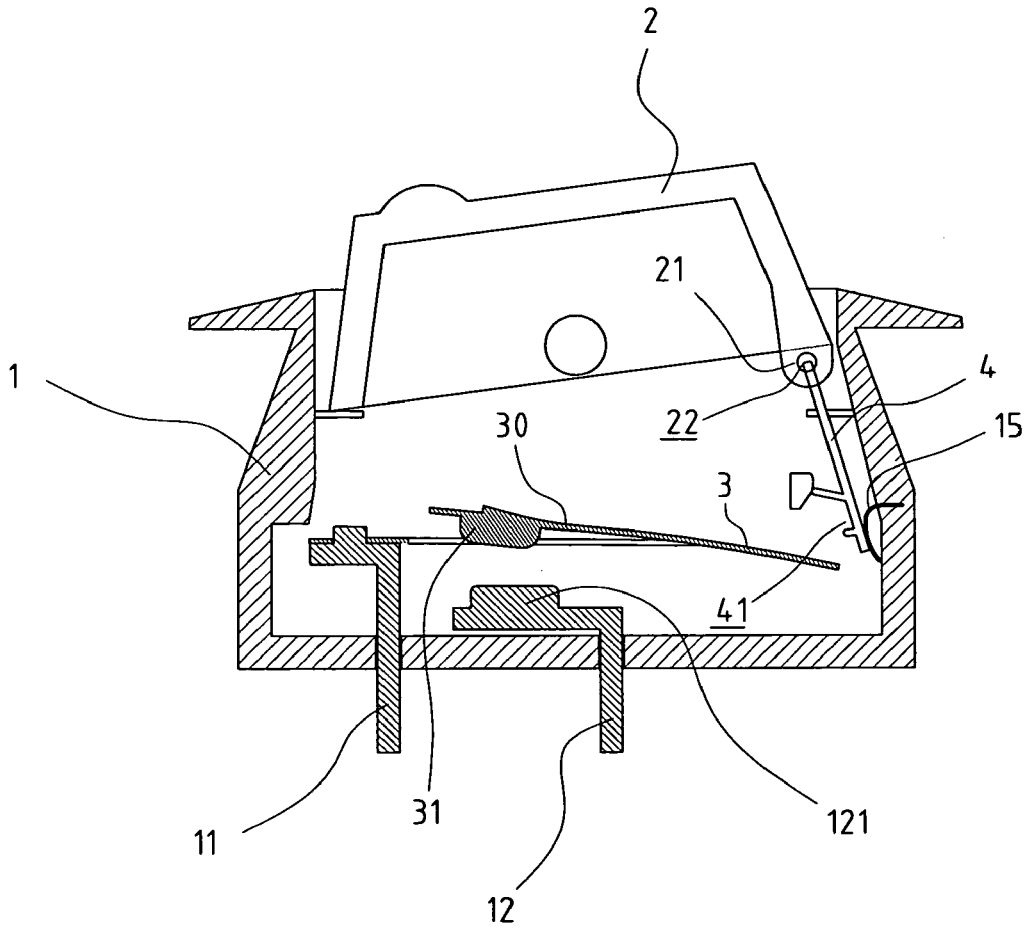
FIG. 18 shows that the first and second contact points are separated due to the deformation of the bimetallic plate when the switch device is overloaded while the biasing member in FIG. 14 is used.
Figure 19:
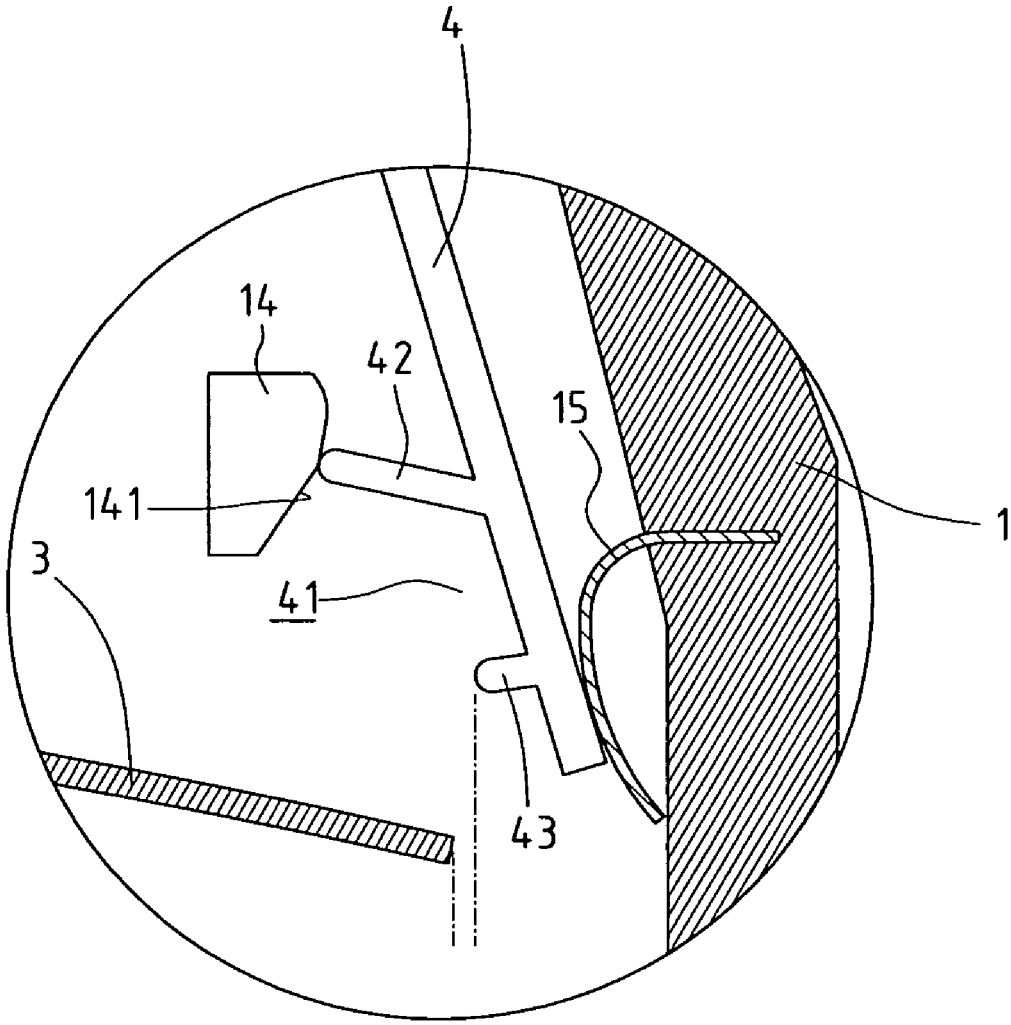
FIG. 19 is an enlarged view to show the second end of the bimetallic plate is disengaged from the hooking portion of the hooking member as shown in FIG. 18.

Further referring to FIGS. 9 and 10, a hooking member 4 has a rod 40 extending laterally from a first end thereof and is inserted through a hole 22 defined through an extension plate 21 extending from an end of an underside of the switch member 2. A second end of the hooking member 4 has a hook portion 41 that is defined between a first board 42 and a second board 43 that is located below the first board 42 and shorter than the first board 42. The second end of the bimetallic plate 3 is removably engaged with the hook portion 41. A biasing member 13 is connected to an inside of the case 1 and a side opposite to the hook portion 41 of the hooking member 4 contacts the biasing member 13. The biasing member 13 is a curve plate whose periphery is connected to the inside of the case 1 so as to form a hollow dome.

Figure 3:
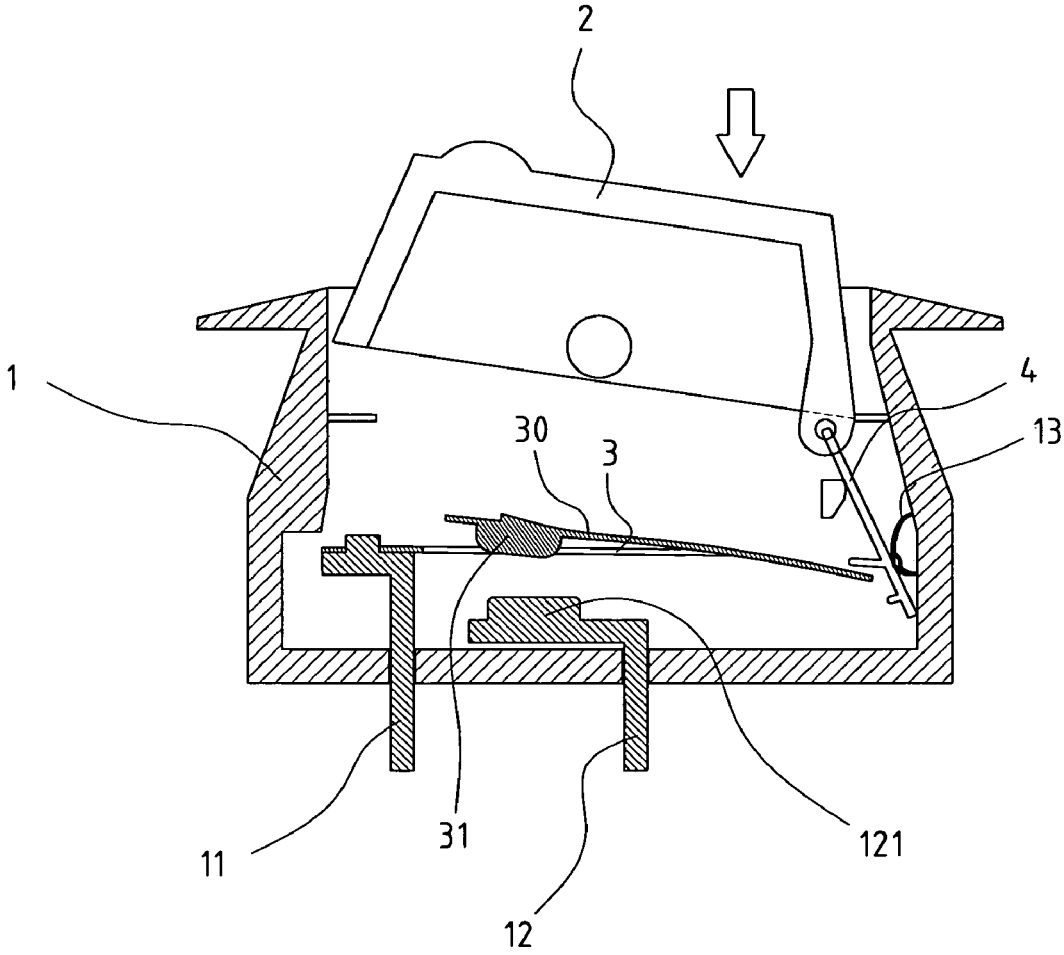
FIG. 3 shows an "OFF" status of the switch device of the present invention.
Figure 4:
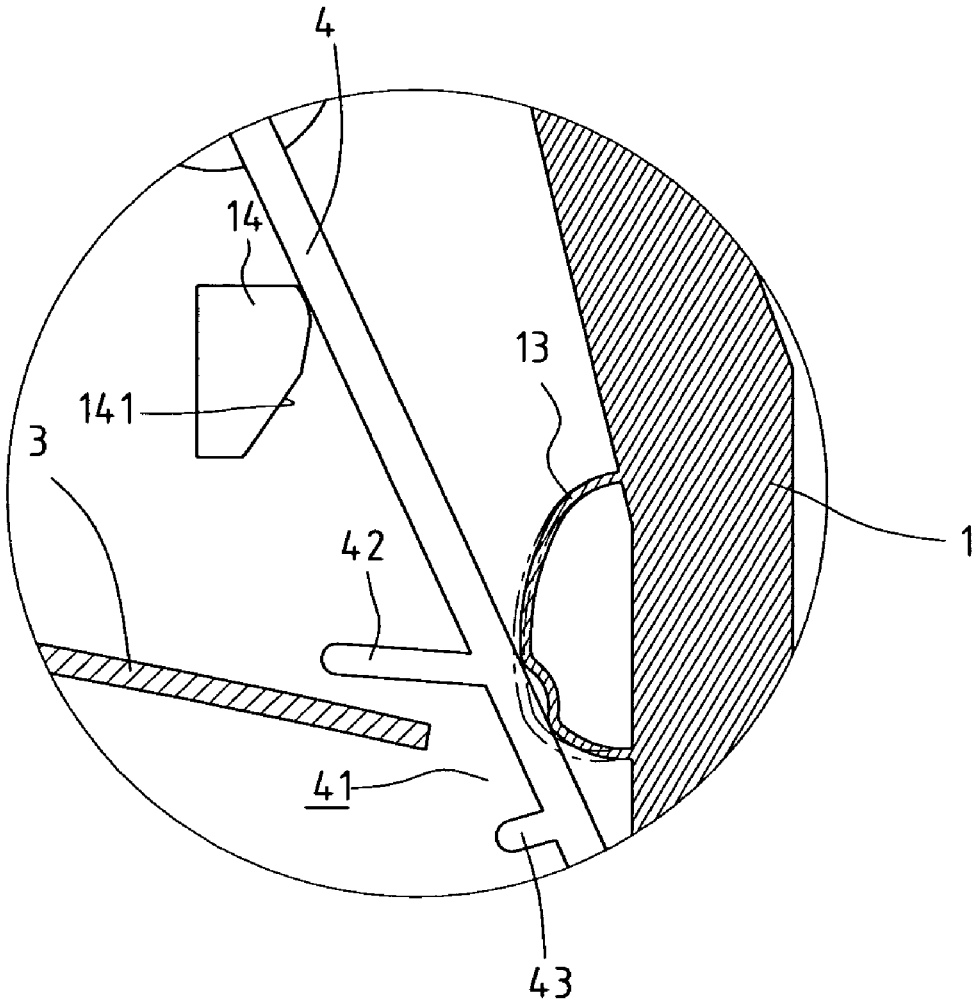
FIG. 4 is an enlarged view showing positional relationship between the hooking portion and the second end of the bimetallic plate at the "QFF" status of the switch device of the present invention.
Figure 5:
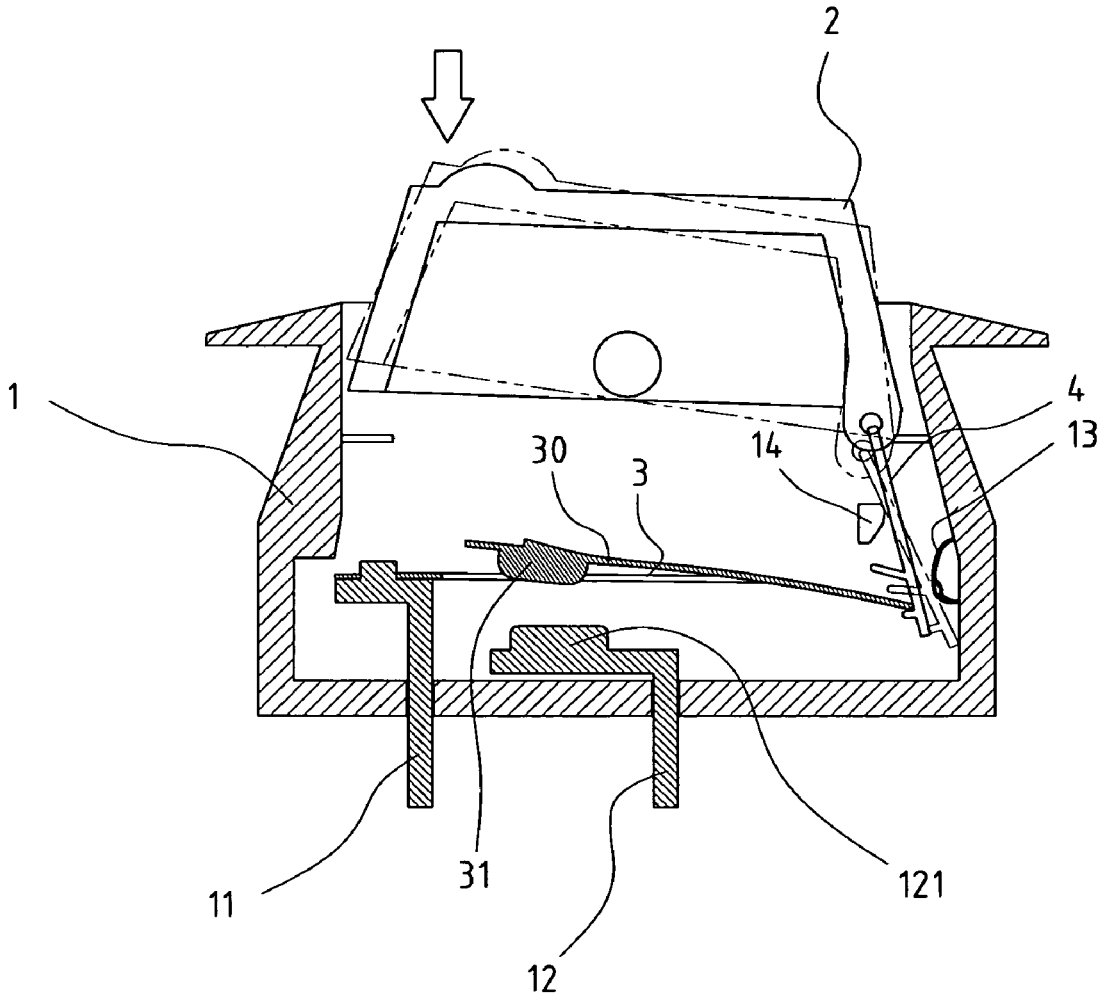
FIG. 5 shows a hooking member guided by a biasing member when a switch member is pushed to "ON" position.
Figure 6:
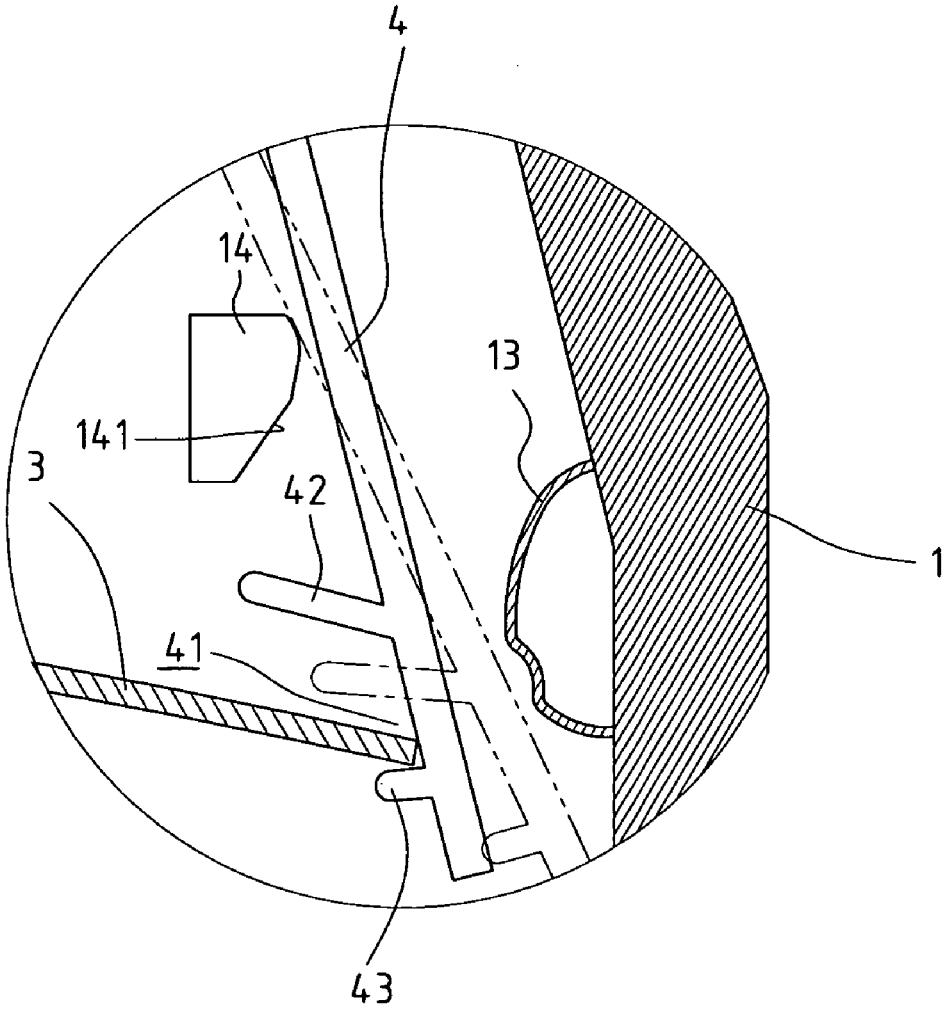
FIG. 6 is an enlarged view to show the second end of the bimetallic plate is lifted by a second board of the hooking portion of the hooking member.

Referring to FIGS. 3 and 4, when pushing the right end of the switch member 2, the first board 42 moves the second end of the bimetallic plate 3 downward and the first contact point 31 is lifted to disengage from the second contact point 121 so that the switch device is set to "OFF" status. As shown in FIGS. 5 and 6, when pushing the left end of the switch member 2, the hooking member 4 is biased toward a block 14 extending from another inside of the case 1. The second end of the bimetallic plate 3 is lifted by the second board 43, so that the free end 30 is deformed downward and the first and second contact points 31, 121 are in contact with each other. The first board 42 is moved to contact the inclined surface 141 on the block 14 when the right end of the switch member 2 is pivoted upward.

Referring to FIGS. 10–13, when the switch device is in "ON" status and the switch device is overloaded, the bimetallic plate 3 is deformed and because the second board 43 is shorter so that the second end of the bimetallic plate 3 is allowed to be deformed downward without obstruction. As can be seen from FIGS. 2, 11 and 13, the inclined surface 141 of the block 14 guides the first board 42 and the hooking member 4 as well as the second board 43 away from the bimetallic plate 3. The second board 43 is shorter to ensure that there is a space for the bimetallic plate 3 to be deformed freely without being blocked by the second board. The deformation makes the first contact point 31 disengage from the second contact point 121 to cut off the circuit.

Referring to FIGS. 14–19, the biasing member 15 can be a flexible curved plate which has one end fixed to the inside of the case 1 and the other end is bent inward so as to provide a biasing force to the hooking member 4.

While we have shown and described the embodiment in accordance with the present invention, it should be clear to those skilled in the art that further embodiments may be made without departing from the scope of the present invention.

What is claimed is:

1. A safety switch device comprising:

a case having an open top and a switch member pivotally engaged with the open top of the case;

a first terminal and a second terminal respectively extending through a bottom of the case, a bimetallic plate having a first end fixed to the first terminal and a first contact point connected to a free end of the bimetallic plate, a second contact point connected to the second terminal and located beneath the first contact point;

a hooking member having a first end pivotally connected to an end of the switch member and a second end of the hooking member having a hook portion formed by an upper board and a lower board, a second end of the bimetallic plate removably engaged with the hook portion between the upper and lower boards;

a biasing member connected to an inside of the case and a back side opposite to the hook portion of the hooking member contacting the biasing member; and a block extending from another inside of the case and including an inclined surface, the biasing member pushing the hooking member against the block which guides movement of the hooking member;

wherein the lower board lifts the second end of the bimetallic plate up to connect the first contact point to the second contact point and then the upper board is raised against and guided by the inclined surface of the block to maintain a space between the lower board and the second end of the bimetallic plate when the switch member is pressed down on a first side, and the upper board presses the second end of the bimetallic plate down to disconnect the first contact point from the second contact point when the switch member is pressed down on a second side.

2. The safety switch device as claimed in claim 1, wherein the biasing member is a curve plate whose periphery is connected to the inside of the case so as to form a hollow dome.

3. The safety switch device as claimed in claim 1, wherein the biasing member is a flexible curved plate having one end fixed to the inside of the case.

4. The safety switch device as claimed in claim 1, wherein the switch member includes an extension plate extending from an underside of the end of the switch member thereof and a hole is defined through the extension plate for connecting the hooking member.

5. The safety switch device as claimed in claim 4, wherein a rod is extended from the first end of the switch member and inserted through the hole of the extension plate.

6. The safety switch device as claimed in claim 1, wherein the lower board is shorter than the upper board.

* * * * *